US011276914B2

(12) United States Patent
Heath et al.

(10) Patent No.: US 11,276,914 B2
(45) Date of Patent: Mar. 15, 2022

(54) ANTENNA MOUNTS AND ASSEMBLIES

(71) Applicant: CommScope Technologies LLC, Hickory, NC (US)

(72) Inventors: Dale Heath, Fort Worth, TX (US); Matthew Severin, Grapevine, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/951,408

(22) Filed: Nov. 18, 2020

(65) Prior Publication Data

US 2021/0175600 A1 Jun. 10, 2021

Related U.S. Application Data

(60) Provisional application No. 62/945,555, filed on Dec. 9, 2019.

(51) Int. Cl.
*H01Q 1/12* (2006.01)
*H01Q 1/24* (2006.01)

(52) U.S. Cl.
CPC ..... *H01Q 1/1221* (2013.01); *H01Q 1/1228* (2013.01); *H01Q 1/1242* (2013.01); *H01Q 1/246* (2013.01)

(58) Field of Classification Search
CPC ..... H01Q 1/221; H01Q 1/228; H01Q 1/242; H01Q 1/246
See application file for complete search history.

(56) References Cited

U.S. PATENT DOCUMENTS 5,971,345 A * 10/1999 Khalaf ..... H01Q 1/125 248/512
6,018,325 A 1/2000 Lundgren
7,557,771 B1 * 7/2009 Hodges ..... H01Q 1/1221 343/878
2011/0156984 A1 6/2011 Caldwell et al.
(Continued)

FOREIGN PATENT DOCUMENTS

JP 2005318077 A 11/2005
KR 200383006 Y1 4/2005
WO 2010098653 A2 9/2010

OTHER PUBLICATIONS

"International Search Report and Written Opinion corresponding to International Application No. PCT/US2020/060952 dated Mar. 11, 2021".

*Primary Examiner* — Hoang V Nguyen
(74) *Attorney, Agent, or Firm* — Myers Bigel, P.A.

(57) ABSTRACT

The present disclosure describes antenna mounts. An antenna mount may include a base, a main pole coupled to or integral with the base and extending upwardly from the base, a cross-support pole coupled to a top end of the main pole and oriented perpendicular relative to the main pole, and at least one mounting pole coupled to or integral with the cross-support pole and extending upwardly from the cross-support pole. Each mounting pole may be configured to secure an antenna to the antenna mount. The antenna mount may be configured to be installed and stand adjacent to or flush against an exterior wall of a building and carry the load weight of the antennas to and through the base of the antenna mount to a ground surface and away from the exterior wall of the building. Antenna mount assemblies are also provided.

19 Claims, 7 Drawing Sheets

(56) References Cited

U.S. PATENT DOCUMENTS

| | | | | |
|---|---|---|---|---|
| 2015/0380805 | A1* | 12/2015 | Arranz | H01Q 9/16 343/793 |
| 2018/0277921 | A1* | 9/2018 | Ming | H01Q 1/12 |
| 2019/0273313 | A1* | 9/2019 | Schwartz | H01Q 1/246 |

* cited by examiner

ANTENNA MOUNTS AND ASSEMBLIES

RELATED APPLICATION(S)

The present application claims priority from and the benefit of U.S. Provisional Application Ser. No. 62/945,555, filed Dec. 9, 2019, the disclosure of which is hereby incorporated herein in its entirety.

FIELD

The present application is directed generally toward telecommunications equipment, and more particularly, telecommunications antenna mounts and antenna mount assemblies.

BACKGROUND

Currently, different types of 5G small cell antennas 10, 10', 10" may be mounted on the exterior wall of a building 12 (see, e.g., FIGS. 1A-1C). However, the exterior wall may not always be able to support the weight load of the antenna(s) 10, 10', 10" because the construction material (i.e., stucco, faux brick, paneling, granite, hollow walls, etc.) cannot provide the support needed. This requires an installer to penetrate into a structural member within the wall or penetrate through both walls of the exterior to properly support the load of the antenna 10, 10', 10", which can increase installation costs and can result in damage to the exterior wall. Other roadblocks during installation may arise, such as obtaining public right-of-way permits and/or facing leasing issues prohibiting penetration into the exterior of a building 12.

SUMMARY

A first aspect of the present invention is directed to an antenna mount. The antenna mount includes a base, a main pole coupled to or integral with the base and extending upwardly from the base, a cross-support pole coupled to a top end of the main pole and oriented perpendicular relative to the main pole, and at least one mounting pole coupled to or integral with the cross-support pole and extending upwardly from the cross-support pole. Each mounting pole is configured to secure an antenna and possibly lighting to the antenna mount. The antenna mount is configured be installed and stand adjacent to an exterior wall of a building and carry the load weight of the antenna(s) to and through the base of the antenna mount to a ground surface and away from the exterior wall of the building.

Another aspect of the present invention is directed to an antenna mount assembly. The antenna mount assembly includes a mounting structure, an antenna mount, and one or more antennas. The antenna mount includes a base, a main pole coupled to or integral with the base and extending upwardly from the base, a cross-support pole coupled to a top end of the main pole and oriented perpendicular relative to the main pole, and at least one mounting pole coupled to or integral with the cross-support pole and extending upwardly from the cross-support pole. The one or more antennas are each secured to a respective mounting pole. The mounting structure is a building and the antenna mount is installed and stands adjacent to an exterior wall of the building and carries the load weight of the one or more antennas to and through the base of the antenna mount to a ground surface and away from the exterior wall of the building.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

DETAILED DESCRIPTION

Figure 1A:
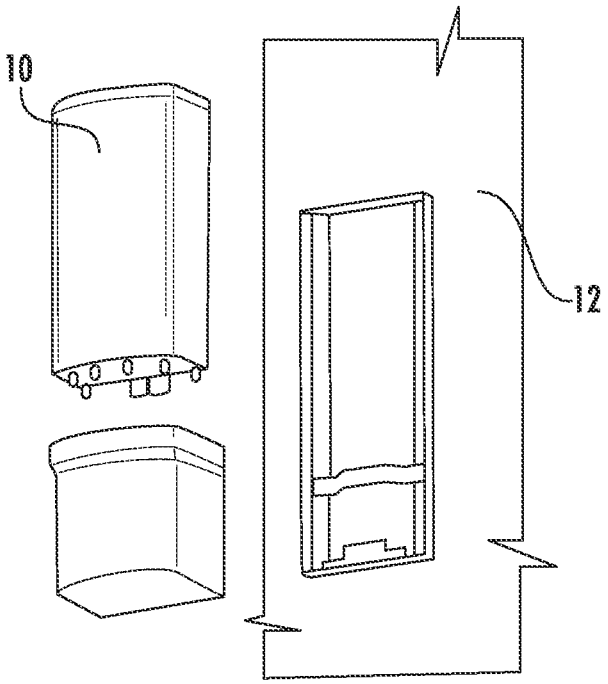
FIG. 1A PRIOR ART
FIGS. 1A-1C are photographs of prior antenna mounts for mounting antennas to the exterior wall of a building.
Figure 1B:
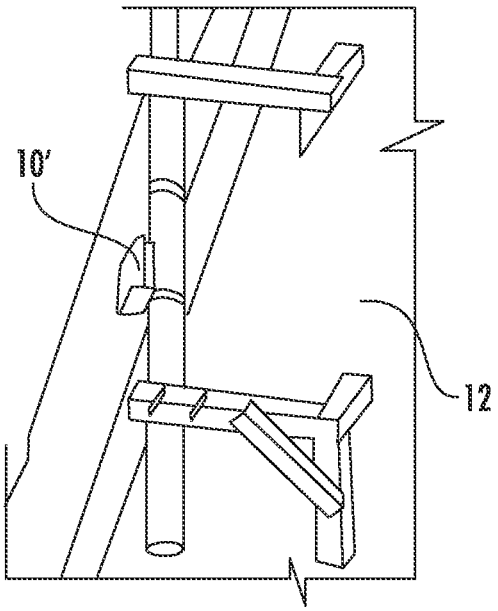
FIG. 1B PRIOR ART
Figure 1C:
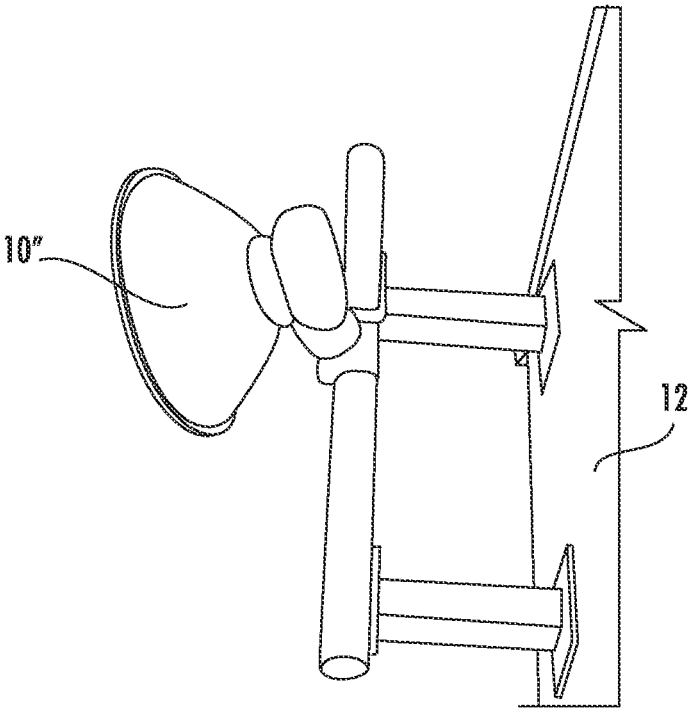
FIG. 1C PRIOR ART

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention now will be described more fully hereinafter with reference to the accompanying drawings, in which illustrative embodiments of the invention are shown. Like numbers refer to like elements throughout and different embodiments of like elements can be designated using a different number of superscript indicator apostrophes (e.g., 10', 10", 10'").

In the figures, certain layers, components or features may be exaggerated for clarity, and broken lines illustrate optional features or operations unless specified otherwise. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Pursuant to embodiments of the present invention, antenna mounts are provided that may provide the ability to mount one or more telecommunications antennas adjacent to an exterior wall of a building with minimal or no penetration of the wall and with minimal cable or equipment exposure. Antenna mount assemblies are also provided. Embodiments of the present invention will now be discussed in greater detail with reference to FIGS. 2A-9.

Figure 2A:
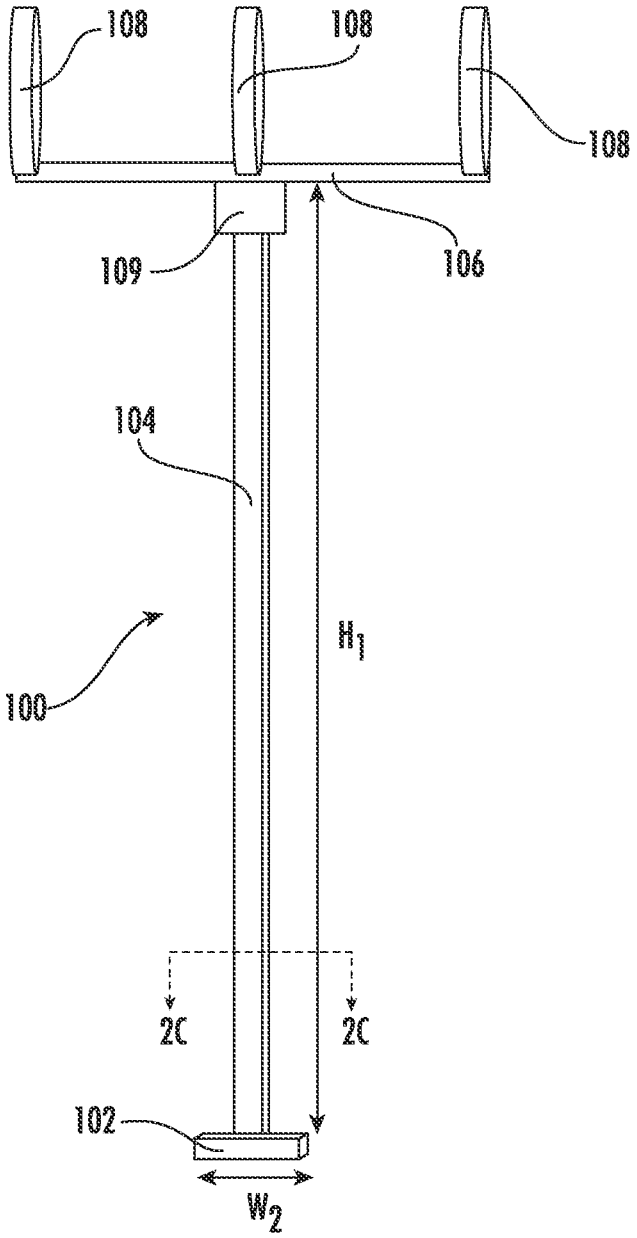
FIG. 2A is a front perspective view of an antenna mount according to embodiments of the present invention.
Figure 2C:
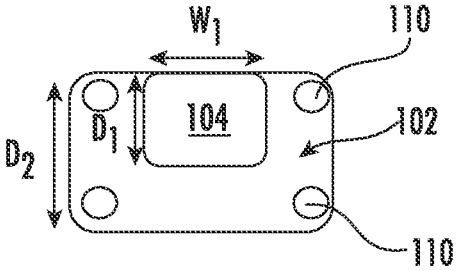
FIG. 2C is a top section view of the base of the antenna mount of FIG. 2A taken through lines 2C-2C.
Figure 2D:
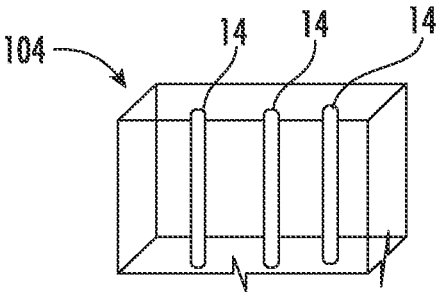
FIG. 2D is a partial cross-sectional view of the main pole of the antenna mount of FIG. 2A with cables routed through the main pole.
Figure 2B:
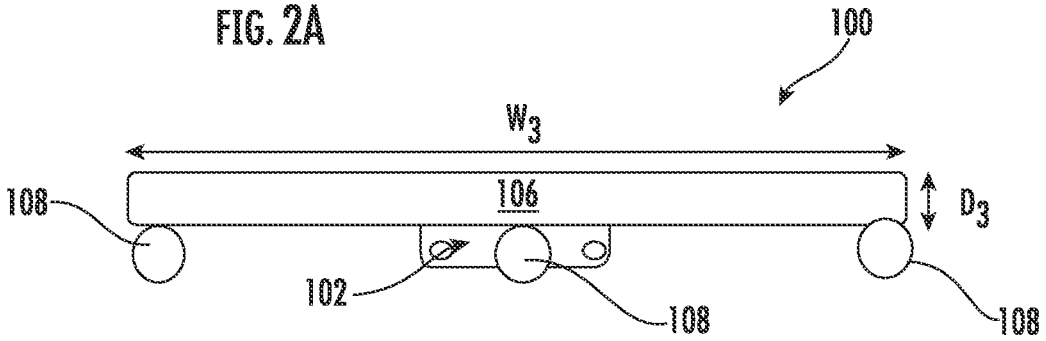
FIG. 2B is a top view of the antenna mount of FIG. 2A.

Referring to FIGS. 2A-2D, an antenna mount 100 according to embodiments of the present invention is illustrated. As shown in FIG. 2A-2C, the mount 100 includes a base 102, a main pole 104, a cross-support pole 106, and at least one mounting pole 108.

As discussed in further detail below, the base 102 (and/or anchoring system 300) is configured to support the load weight of one or more antennas 12 (or other telecommunications equipment, such as, radio diplexers, power supply units and/or lighting) that may be mounted to the antenna mount 100. In other words, the antenna mount 100 supports the load weight of the antennas 10, 10, 10" away from the exterior wall of a building 12. The base 102 may be rectangular in shape having a width $W_2$ and a depth $D_2$. In some embodiments, the base 102 may have a width $W_2$ in the range of about 8 inches to about 18 inches. In some embodiments, the base 102 may have a depth $D_2$ in the range of about 6 inches to about 12 inches. For example, in some embodiments, the base 102 has a width $W_2$ of 8 inches and a depth $D_2$ of 12 inches. It is noted that the dimensions of the base 102 can vary depending on anchor needs, ground conditions, load conditions and/or area constraints.

Figure 9:
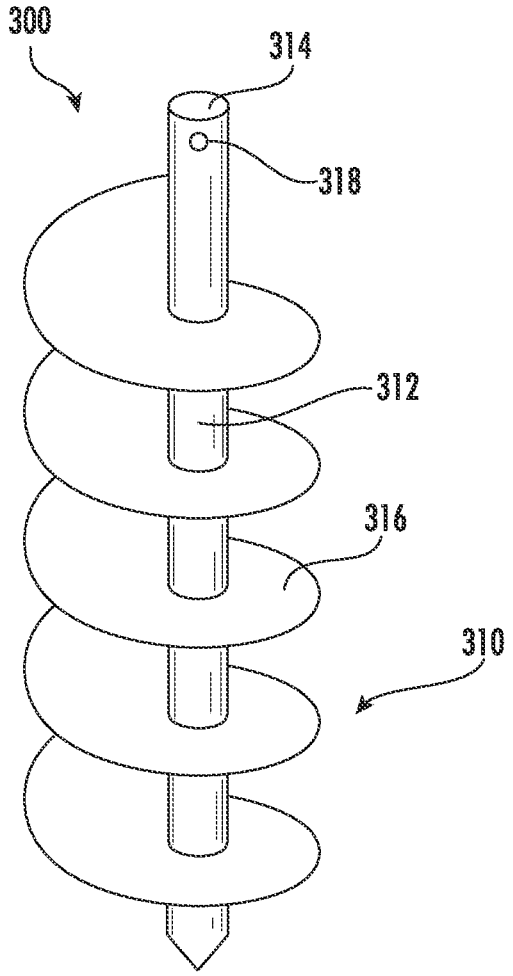
FIG. 9 is a perspective view of an exemplary anchoring system that can be used with the antenna mount of FIG. 1.

In some embodiments, the base 102 of the antenna mount 100 may be secured to a ground surface via bolts 110 (see, e.g., FIG. 2C) or other anchoring system 300 (see, e.g., FIG. 9). Other known methods of securing the antenna mount 100 of the present invention to the ground may be used.

The main pole 104 of the antenna mount 100 is coupled to the base 102 and extends upwardly from the base 102. The main pole 104 may be rectangular in shape having a height $H_1$, width $W_1$, and depth $D_1$. In some embodiments, the main pole 104 has a height $H_1$ in the range of about 240 inches (i.e., about 20 feet) to about 420 inches (i.e., about 35 feet) and has a width $W_1$ in the range of about 4 inches to about 8 inches. The main pole 104 of the antenna mount 100 also has a low profile. For example, in some embodiments, the main pole 104 has a depth $D_1$ in the range of about 3 inches to about 6 inches. For example, in some embodiments, the main pole has a width $W_1$ of 4 inches and a depth $D_1$ of 6 inches. The low profile of the main pole 104 may provide for low impact of front and tangential wind forces on the antenna mount 100. In addition, the dimensions of the main pole 104 may be selected to simulate or resemble a gutter or other feature of the building 12. In some embodiments, a luminaire 109 (e.g., a floodlight) may be mounted on the main pole 104 (see, e.g., FIG. 2A).

In some embodiments, the main pole 104 may be configured to receive one or more cables 14 extending from the one or more mounted antennas 12. For example, as shown in FIG. 2D, in some embodiments, the main pole 104 is tubular (i.e., hollow) and may be configured to allow for the one or more cables 14 to be routed from the antennas 12 through the main pole 104 of the antenna mount 100 (see also, e.g., FIG. 7). In some embodiments, the cables 14 may be routed down to the base 102 of the antenna mount 100 (e.g., when the base 102 comprises a telecommunications cabinet 160 (FIG. 5B). Routing the cables 14 through the main pole 104 both protects and conceals the cable(s) 14 within the antenna mount 100.

As shown in FIG. 2C, the main pole 104 may be located adjacent to an edge of the base 102 (i.e., off-center). This configuration allows for the main pole 104 of the antenna mount 100 to be installed and to stand adjacent to the exterior wall of a building 12 (see, e.g., FIG. 3, FIG. 4B, and FIG. 7). This configuration may also allow the base 102 to act as a counter-balance such that the base 102 may support the load weight of the one or more antennas 10, 10', 10" (and/or telecommunications equipment/cabinet 160) secured to the antenna mount 100. As used herein, the term "adjacent," when used to describe the distance between the antenna mount 100 and the exterior wall of a building 12, means that the antenna mount 100 stands a distance of about 12 inches or less from the exterior wall of the building 12. For example, the antenna mount 100 may stand a distance of about 4 inches (on average) from the building 12.

In some embodiments, the main pole 104 of the antenna mount 100 is configured to be installed and stand substantially flush against the exterior wall of a building 12 (i.e., a distance of about 1 inch or less from the exterior wall of the building 12). In some embodiments, the antenna mount 100 of the present invention may be used in other locations other than adjacent to a building 12. For example, in some embodiments, the antenna mount 100 may be used as a stand-alone unit along a street or road.

Still referring to FIGS. 2A-2C, the cross-support pole 106 of the antenna mount 100 may be coupled to or integral with a top edge of the main pole 104. The cross-support pole 106 is generally perpendicular relative to the main pole 104. In some embodiments, the cross-support pole 106 may be hollow (i.e., tubular in shape). Similar to the main pole 104, the cross-support pole 106 may be configured to receive one or more cables 14 extending from the mounted antenna(s) 10, 10', 10" such that the cables 14 may be routed from the antenna(s) 10, 10', 10" through the cross-support pole 106.

In some embodiments, the cross-support pole 106 may also be rectangular in shape. For example, the cross-support pole 106 may have a width $W_3$ and a depth $D_3$. In some embodiments, the cross-support pole 106 has a width $W_3$ in the range of about 24 inches to about 96 inches. As shown in FIG. 2B, in some embodiments, the cross-support pole 106 has the same low profile (i.e., depth $D_3$) as the main pole 104. For example, in some embodiments, the cross-support pole 106 has depth $D_3$ in the range of about 3 inches to about 6 inches. In some embodiments, the cross-support pole 106 may be a square tube having a height $H_3$ of about 4 inches, a depth $D_3$ of about 4 inches and a width $W_3$ of about 48 inches. Similar to the main pole 104, the low profile of the cross-support pole 106 may provide for low impact of front and tangential wind forces on the antenna mount 100.

The antenna mount 100 of the present invention further includes at least one mounting pole 108 coupled to or integral with the cross-support pole 106. For example, in some embodiments, the mount 100 may comprises three mounting poles 108 (i.e., the mount 100 resembles a three-tined fork or trident, see, e.g., FIG. 2A). In some embodiments, the main pole 104 is the mounting pole 108 (e.g., when the antenna mount 100 comprises one pole for mounting antennas 10, 10', 10"). In some embodiments, the mounting poles 108 are evenly spaced apart on the cross-support pole 106. Each mounting pole 108 is configured to secure a telecommunications antenna 10, 10', 10" (or other telecommunications equipment) to the antenna mount 100 (see, e.g., FIGS. 6-8). In some embodiments, the mounting poles 108 are each configured to secure a small cell antenna (e.g., 5G antenna) to the antenna mount 100. An exemplary antenna 10, 10', 10" that may be used with the antenna mount 100 of the present invention is CommScope Product No. NNVVSSP-360-FN (CommScope, Inc., Joliet, Ill.).

In some embodiments, the mounting poles 108 may be hollow (i.e., tubular in shape). Similar to the main and cross-support poles 104, 106, the mounting poles 108 may be configured to receive one or more cables 14 extending from the mounted antenna(s) 10, 10', 10" such that the cables 14 may be routed from the antenna(s) 10, 10', 10" through the mounting poles 108. In some embodiments, each pole (i.e., main pole 104, cross-support pole 106, and mounting poles 108) of the mount 100 may be formed of steel.

Figure 3:
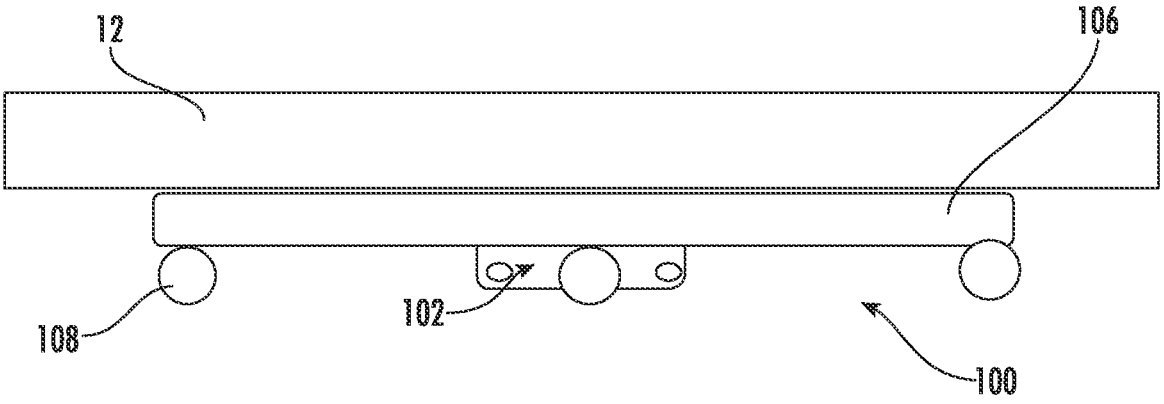
FIG. 3 is a top view of the antenna mount of FIG. 2A installed flush to an exterior wall of a building.

Referring now to FIG. 3, as discussed above, in some embodiments, the antenna mount 100 of the present invention is configured such that the mount 100 stands flush against an exterior wall of a building 12. The low profile design of the antenna mount 100 may provide low impact to front and tangential wind forces. As shown in FIG. 3, the mount 100 of the present invention stands flush against the exterior wall of a building 12 with minimal or no penetration into the wall. The flush mounted (low profile) design of the mount 100 may also carry the load weight of the mounted antennas 10, 10', 10" (or telecommunications equipment) to and through the base 102 to an anchoring system 300 on the ground surface (i.e., away from the exterior wall of the building 12) (see also, e.g., FIG. 7 and FIG. 8).

The antenna mount 100 of the present invention may be anchored using a variety of different methods. For example, the antenna mount 100 may use anchors (e.g., bolts 110) in an existing surface (see, e.g., FIG. 2C) or a ballasted platform. Helical anchors 310 which are spun into the ground may be used to provide a raised mounting surface for the antenna mount 100. FIG. 9 shows an exemplary helical anchor 310 that may be used as the anchoring system 300 for the antenna mount 100 of the present invention. As shown in FIG. 9, the helical anchor 310 may comprise a shaft 312 having a square top end 314 and a blade 316 that follows a helical path around and along the shaft 312. A hole 128 may extend through the top end 314. A concrete peer or footing which uses a poured or preformed, embedded concrete structure (see, e.g., FIG. 8) may be used to anchor the antenna mount 100. Another example method of anchoring the antenna mount 100 may be embedment which is similar to the helical anchor 310 method but instead of spinning the anchors into the ground, utilizes a compact or poured/fill methodology. Note that other known methods or systems of anchoring the antenna mount 100 of the present invention may be used.

Figure 4A:
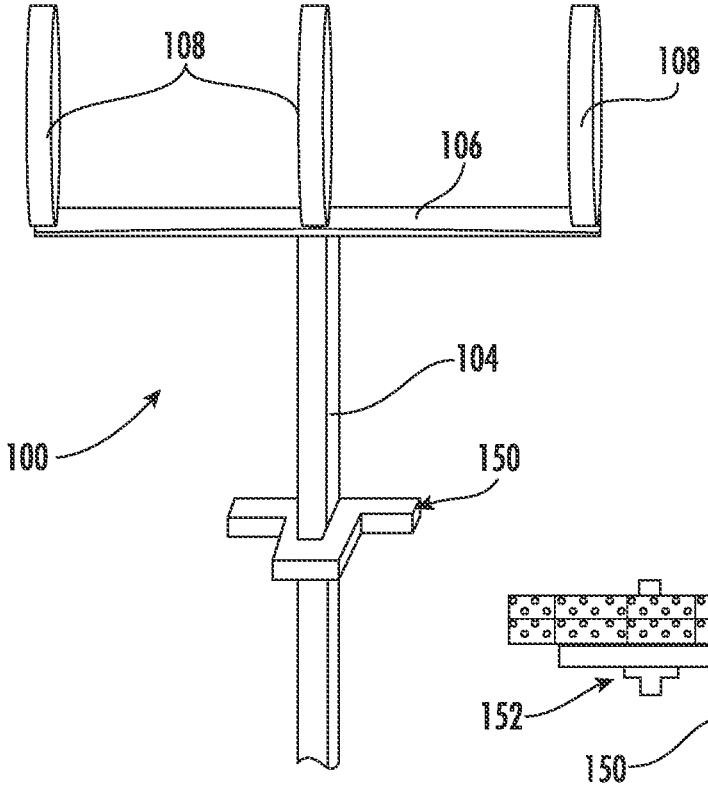
FIG. 4A is a partial front perspective view of the antenna mount of FIG. 2A with a supporting bracket according to embodiments of the present invention.
Figure 4B:
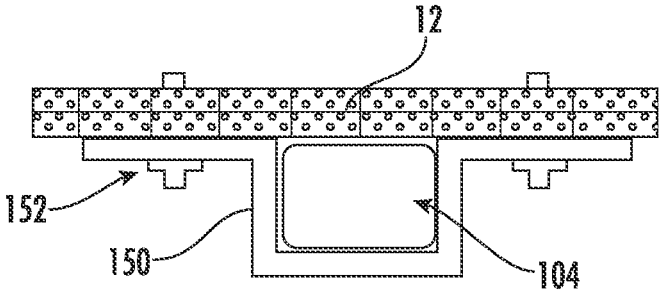
FIG. 4B is a top view of the main pole of the antenna mount of FIG. 2A secured flush against the exterior wall of a building by the supporting bracket of FIG. 4A according to embodiments of the present invention.

Referring to FIGS. 4A-4B, in some embodiments, the antenna mount 100 of the present invention may further include one or more supporting brackets 150. As shown in FIG. 4B, a supporting bracket 150 may be configured to match the profile of the main pole 104 of the mount 100. The supporting bracket(s) 150 may be used to help hold the main pole 104 flush against the exterior of the building 12. In some embodiments, the supporting brackets 150 may also be used to help reduce deflection of the main pole 104. Bolts 152 may be used to secure the supporting brackets 150 to the exterior of the building 12 (with minimal penetration into the exterior of the building 12). In addition, note that when supporting brackets 150 are used with the mount 100 of the present invention, much of the load weight of the mounted antenna(s) 10, 10', 10" is still carried by the base 102 and through to an anchoring system 300 (e.g., bolts 110 or helical anchors 310) of the mount 100 and away from the exterior of the building 12.

Figure 5A:
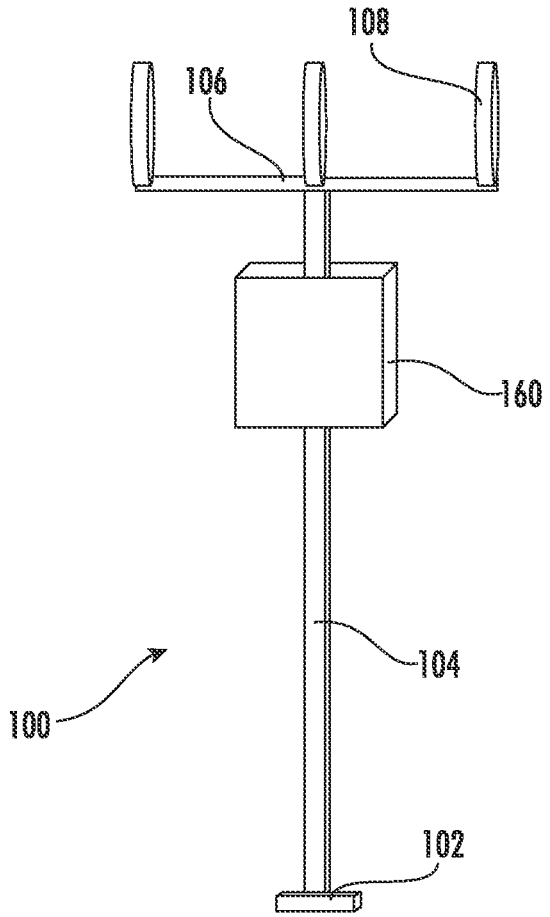
FIG. 5A is a front perspective view of the antenna mount of FIG. 2A with a telecommunications equipment cabinet mounted on the main pole of the mount according to embodiments of the present invention.
Figure 5B:
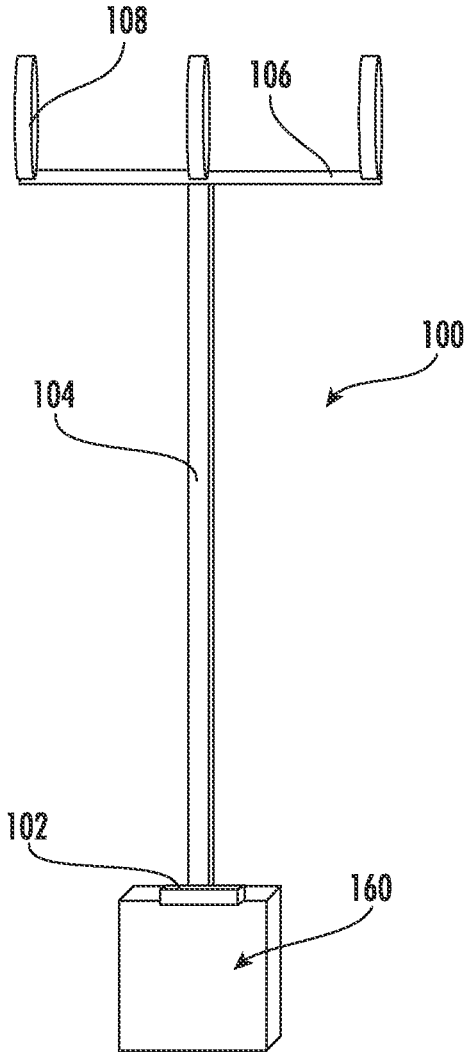
FIG. 5B is a front perspective view of the antenna mount of FIG. 2A with a telecommunications equipment cabinet integrated as the base of the mount according to embodiments of the present invention.

Referring to FIGS. 5A-5B, in some embodiments, the antenna mount 100 of the present invention may comprise a telecommunications equipment/power cabinet 160. The cabinet 160 may include electronic equipment, for example, multi-carrier power amplifiers, house power cells, routers, switching equipment, transmission equipment, power supplies, batteries, wireless cell site backhaul equipment, baseband units, Fiber Panels, OVPs, or the like. As shown in FIG. 5A, in some embodiments, the antenna mount 100 may be configured such that the telecommunications cabinet 160 may be secured to the main pole 104 of the mount 100. In some embodiments, the cabinet 160 may be integrated into the structure at the base 102 of the mount 100 or integrated as the base 102 of the mount 100 (FIG. 5B). In some embodiments, the cabinet 160 may provide a wider base 102 to help support a heavier load weight mounted on the antenna mount 100. The cabinet 160 may act as an intermediate base to transfer the load weight of the antenna mount 100 to the anchoring system 300 on the ground surface. An exemplary cabinet 160 that may be used with the antenna mount 100 of the present invention is CommScope's PoleCab (CommScope, Inc., Joliet, Ill.).

As discussed herein, cables 14 extending from the mounted antennas 10, 10', 10" may be routed through the main pole 104 (and cross-support pole 106 and mounting poles 108) of the mount 100 to a cabinet 160 secured to the main pole 104 or at the base 102 of the mount 100. The design of the mount 100 also carries the load weight of any mounted cabinet 160 to the base 102 and anchoring system 300 of the mount 100 (and away from the exterior of the building 12).

Figure 6:
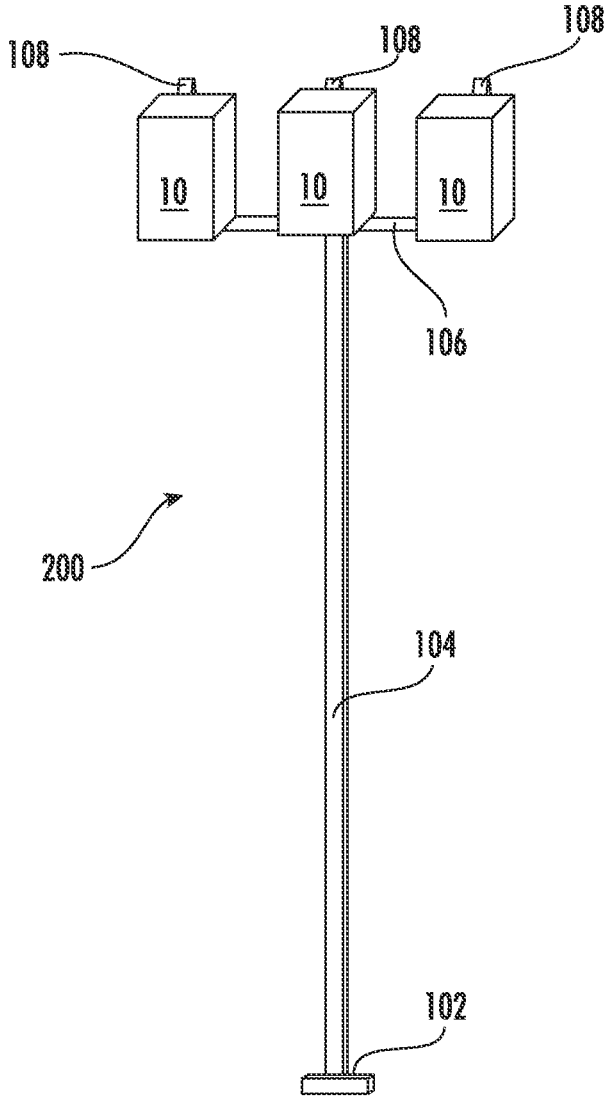
FIG. 6 is a front perspective view of an antenna mount assembly according to embodiments of the present invention utilizing an antenna mount of FIG. 2A.
Figure 7:
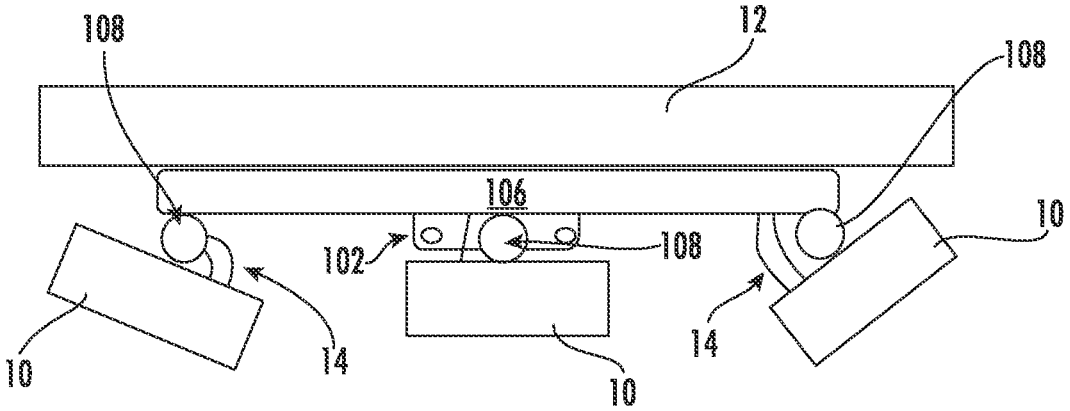
FIG. 7 is a top view of the antenna mount assembly of FIG. 5 installed adjacent to an exterior wall of a building.
Figure 8:
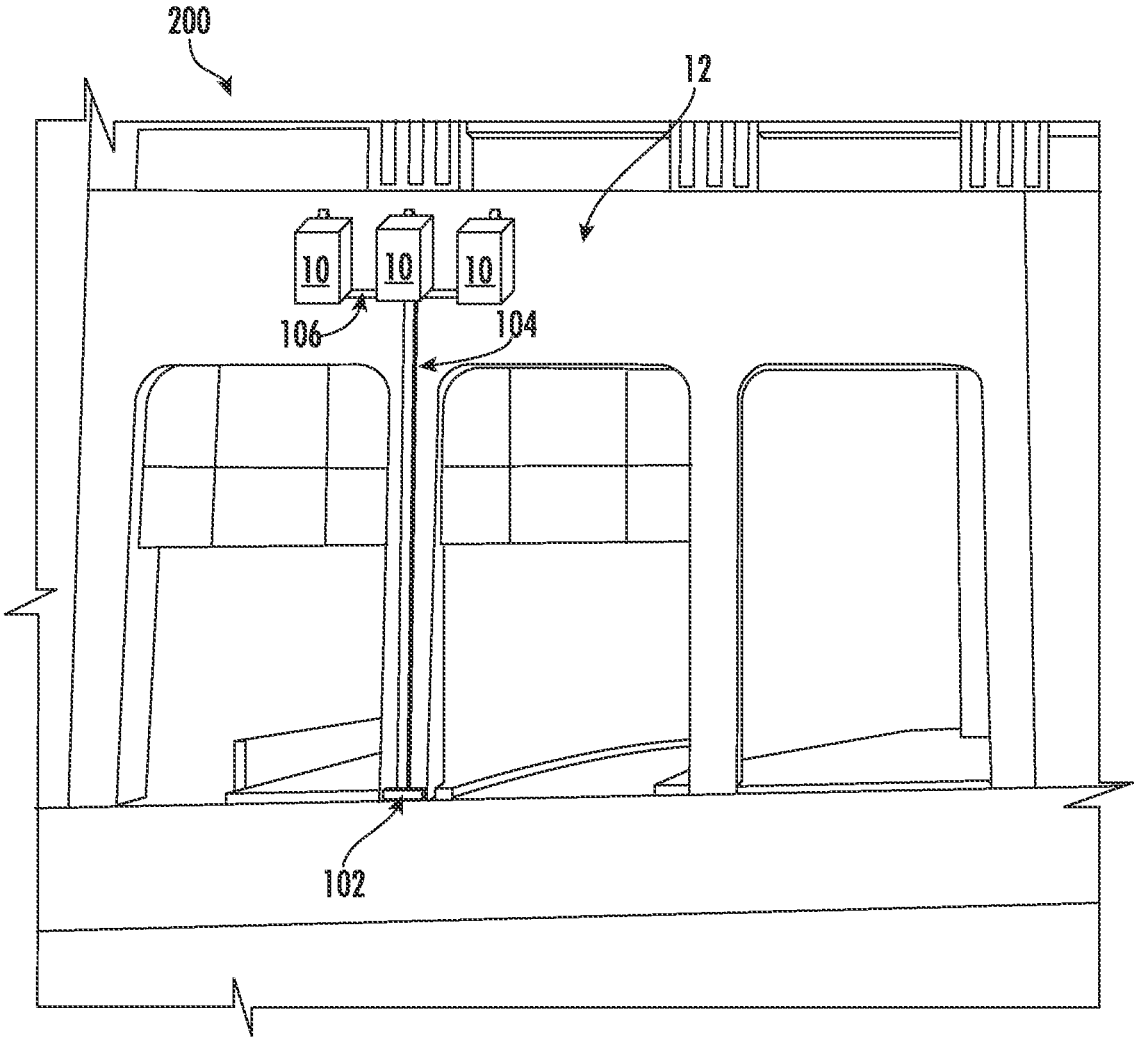
FIG. 8 is a front view of the antenna mount assembly of FIG. 6.

Antenna mount assemblies are also provided herein. Referring to FIGS. 6-8, an antenna mount assembly 200 according to embodiments of the present invention is illustrated. In some embodiments, the assembly 200 may comprises an antenna mount 100 of the present invention as described above. The assembly 200 may comprises one or more antennas secured to the antenna mount 100. As shown in FIGS. 6-8, the assembly 200 may comprise three antennas secured to the antenna mount 100.

FIG. 7 illustrates a top view of the antenna mount assembly 200 installed flush against the exterior wall of a building 12. As shown in FIG. 7, the tilt or angle of the antennas 10 may be adjusted on the mounting poles 108 to provide the desired coverage of the antennas 10. As discussed herein, cables 14 may be routed from the antennas 10, 10', 10" through the mounting poles 108 and/or the cross-support pole 106 (and the main pole 104). Routing the cables 14 through the poles 104, 106, 108 allows for minimal cable (and/or equipment exposure), thereby both protecting and concealing the cable(s) 14 within the antenna mount 100 (see, e.g., FIG. 8).

FIG. 8 illustrates the antenna mount assembly 200 standing adjacent to the exterior wall of a building 12. In some embodiments, the antenna mount 100 of the assembly 200 may resemble a part of the building's exterior, such as, a gutter or conduit or light pole.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An antenna mount, comprising:

a base;

a main pole coupled to or integral with the base and extending upwardly from the base;

a cross-support pole coupled to a top end of the main pole, wherein the cross-support pole is oriented perpendicular relative to the main pole; and at least one mounting pole coupled to or integral with the cross-support pole and extending upwardly from the cross-support pole, each mounting pole configured to secure an antenna to the antenna mount, wherein the antenna mount is configured to be installed and stand adjacent to an exterior wall of a building and carry the load weight of the antennas to and through the base of the antenna mount to a ground surface and away from the exterior wall of the building.

2. The antenna mount of claim 1, wherein the antenna mount is configured to be installed and stand substantially flush against the exterior wall of the building.

3. The antenna mount of claim 2, wherein the antenna mount stands flush against the exterior wall of a building without securing the antenna mount to the wall.

4. The antenna mount of claim 1, wherein the main pole is rectangular in shape having a profile with a depth in the range of about 3 inches to about 6 inches.

5. The antenna mount of claim 1, further comprising one or more supporting brackets configured to secure the main pole flush against the exterior wall of the building and reduce deflection of the antenna mount away from the building.

6. The antenna mount of claim 1, wherein an antenna is secured to each of the mounting poles.

7. The antenna mount of claim 6, further comprising one or more cables routed from each of the antennas through the main pole of the antenna mount.

8. The antenna mount of claim 1, wherein the main pole is sized to receive one or more cables extending from each of the antennas.

9. The antenna mount of claim 1, further comprising a telecommunications equipment or power cabinet secured to the main pole of the antenna mount.

10. The antenna mount of claim 1, wherein the base of the antenna mount comprises a telecommunications equipment or power cabinet.

11. The antenna mount of claim 1, wherein the antenna mount resembles a gutter or conduit of the building.

12. An antenna mount assembly, comprising:

a mounting structure;

an antenna mount, the antenna mount comprising:

a base;

a main pole coupled to or integral with the base and extending upwardly from the base;

a cross-support pole coupled to a top end of the main pole, wherein the cross-support pole is oriented perpendicular relative to the main pole; and at least one mounting pole coupled to or integral with the cross-support pole and extending upwardly from the cross-support pole; and one or more antennas, each antenna secured to a respective mounting pole, wherein the mounting structure is a building, and wherein the antenna mount is installed and stands adjacent to an exterior wall of the building and carries the load weight of the one or more antennas to and through the base of the antenna mount to a ground surface and away from the exterior wall of the building, wherein the antenna mount is installed and stands substantially flush with the exterior wall of the building.

13. The antenna mount assembly of claim 12, wherein the assembly further comprises one or more supporting brackets securing the antenna mount flush against the exterior wall of the building.

14. The antenna mount assembly of claim 12, wherein the antenna mount stands flush against the exterior wall of the building without securing the antenna mount into the wall.

15. The antenna mount assembly of claim 12, further comprising an anchoring system that carries the load weight of the one or more antennas.

16. The antenna mount assembly of claim 12, wherein the main pole of the antenna mount is tubular, and the assembly further comprises one or more cables extending from each of the antennas and routed through the mounting poles, cross-support pole, and main pole of the antenna mount to the base of the antenna mount.

17. The antenna mount assembly of claim 12, wherein the assembly further comprises a telecommunications equipment or power cabinet secured to the main pole of the antenna mount.

18. The antenna mount assembly of claim 12, wherein the base of the antenna mount comprises a telecommunications equipment or power cabinet.

19. The antenna mount assembly of claim 12, wherein the antenna mount resembles a gutter or conduit of the building.

* * * * *